US005791523A

United States Patent [19]

Oh

[11] Patent Number: 5,791,523

[45] Date of Patent: Aug. 11, 1998

[54] BEVERAGE DISPENSING APPARATUS FOR A REFRIGERATOR

[75] Inventor: Gil-Soo Oh, Suwon, Rep. of Korea

[73] Assignee: SamSung Electronics Co., Ltd., Suwon, Rep. of Korea

[21] Appl. No.: 769,523

[22] Filed: Dec. 19, 1996

[30] Foreign Application Priority Data

| | | | |
|---|---|---|---|
| Dec. 19, 1995 | [KR] | Rep. of Korea | 1995-52134 |
| Dec. 19, 1995 | [KR] | Rep. of Korea | 1995-52135 |
| Oct. 21, 1996 | [KR] | Rep. of Korea | 1996-47121 |

[51] Int. Cl.[6] ..... B67D 5/62

[52] U.S. Cl. ..... 222/146.6; 222/504; 222/509; 62/338; 251/65

[58] Field of Search ..... 222/31, 153.09, 222/148.6, 183, 504, 509; 62/337–339, 377, 396; 137/374; 251/65

[56] References Cited

U.S. PATENT DOCUMENTS

| | | | |
|---|---|---|---|
| 2,121,281 | 6/1938 | Bosque | 62/338 |
| 2,777,304 | 1/1957 | Nave | 222/146.6 |
| 2,781,153 | 2/1957 | Roberts | 222/146.6 |
| 2,914,218 | 11/1959 | Korodi | 62/338 |
| 3,069,869 | 12/1962 | Mueller | 62/396 |
| 5,683,015 | 11/1997 | Lee | 222/146.6 |

*Primary Examiner*—Philippe Derakshani

*Attorney, Agent, or Firm*—Burns, Doane, Swecker & Mathis, L.L.P.

[57] ABSTRACT

A refrigerator includes a beverage dispenser mounted in a refrigerating compartment thereof for dispensing a beverage through the refrigerator door. The dispenser includes a beverage-storing vessel having a beverage outlet in the form of a valved spigot which is arranged to project through a hole in the door when the door is closed. The spigot includes an internal valve which is attached to a first magnet. The door carries a valve actuator which includes a second magnet adapted to generate a magnetic repulsive force against the first magnet to open the valve against a valve-closing spring force when the actuator is moved to a valve-opening position. A sealing arrangement is provided to create an air-tight seal between the spigot and hole when the door is closed. A manually releasable latch is disposed within the refrigerator for releasably retaining the vessel against accidental removal.

10 Claims, 6 Drawing Sheets

BEVERAGE DISPENSING APPARATUS FOR A REFRIGERATOR

BACKGROUND OF THE INVENTION

1. Field of the Invention.

The present invention relates to a beverage dispensing apparatus, and more particularly to a beverage dispensing apparatus for a refrigerator capable of dispensing a beverage (hereinafter cold water) stored in a cooling water storage vessel.

2. Description of the Prior Art.

Generally, FIG. 1 illustrates a typical refrigerator having a conventional construction.

As shown in FIG. 1, the refrigerator includes a refrigerator body 1 provided with food storing compartments, namely a freezing compartment and a refrigerating compartment. At the front portion of the refrigerator body 1, doors 2 and 3 are mounted, which serve to open and close the freezing and refrigerating compartments, and the door 3 is provided at one side thereof with a beverage dispensing apparatus 4.

The beverage dispensing apparatus 4, as shown in FIG. 2, comprises an outlet member 5*a* for discharging cold water which is provided at an inner side of the door 3, a cylinder member 5, which is arranged at a right side of the outlet member 5*a*, a slide member 7 which is arranged in the cylinder member 5, a cooling water storage vessel which contains cooling water.

Furthermore, the cooling water storage vessel 9 is arranged at upper and lower parts thereof with an upper cap 10 and a lower cap 11, and the lower cap 11 is provided at an inner side thereof with a valve body 12 supported by a spring 86, and the valve body 12 is provided at an upper side thereof with a valve 13.

Therefore, the operation of the beverage dispensing apparatus for the refrigerator with the above-mentioned construction will hereinafter be described.

If the cooling water storage vessel 9 is placed on a supporting member 5*b*, the valve 13 serves to close an outlet which is provided at the upper side of the lower cap 11. Cold water w stored in the cooling water storage vessel 9 cannot be discharged under this state. If a user pushes a lever 6 after putting a cup c under the outlet 5*a*, the slide member 7 moves to displace the valve body 12 upward.

Therefore, the valve 13 moves upward, and the outlet opens, so cold water w passes through the lower cap 11, the cylinder 5 and the outlet member in this order. Therefore the cooling water is discharged from the cooling water storage vessel 9.

However, there is a problem in the beverage dispensing apparatus for the refrigerator thus constructed, in that it is difficult to assemble due to a plurality of elements and a manufacturing cost is expensive, and the cylinder and the slide member must be separated from the refrigerator body in order to remove the vessel 9 for cleaning.

SUMMARY OF THE INVENTION

Accordingly, the present invention is provided to solve the aforementioned problems and it is an object of the present invention to provide a beverage dispensing apparatus arranged at one side of a refrigerating compartment, and to increase a quantity of the cooling water for storing in the cooling water storage vessel.

And, it is another object of the present invention to provide a beverage dispensing apparatus which is simple in its construction and at the same time, is convenient to remove for cleaning.

In accordance with the objects of the present invention, there is provided a beverage dispensing apparatus for a refrigerator, the apparatus comprising:

a valved spigot arranged at one side of a cooling water storage vessel, which protrudes out of a closed door;

sealing means arranged at one side of the door, which prevents the cooling air from being leaked outside; and locking means for locking the cooling water storage vessel in place to enable the door to be opened.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

The embodiment of the present invention will now be described in detail with reference to the accompanying drawings.

Figure 1:
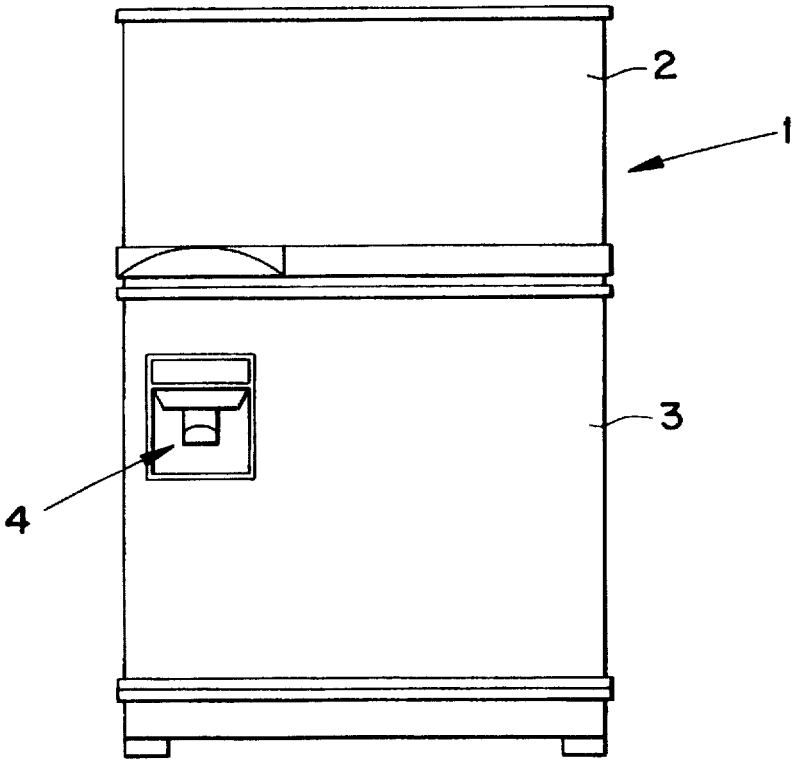
FIG. 1 (PRIOR ART)
FIG. 1 is a front view for illustrating an exterior of a refrigerator according to the prior art.
Figure 2:
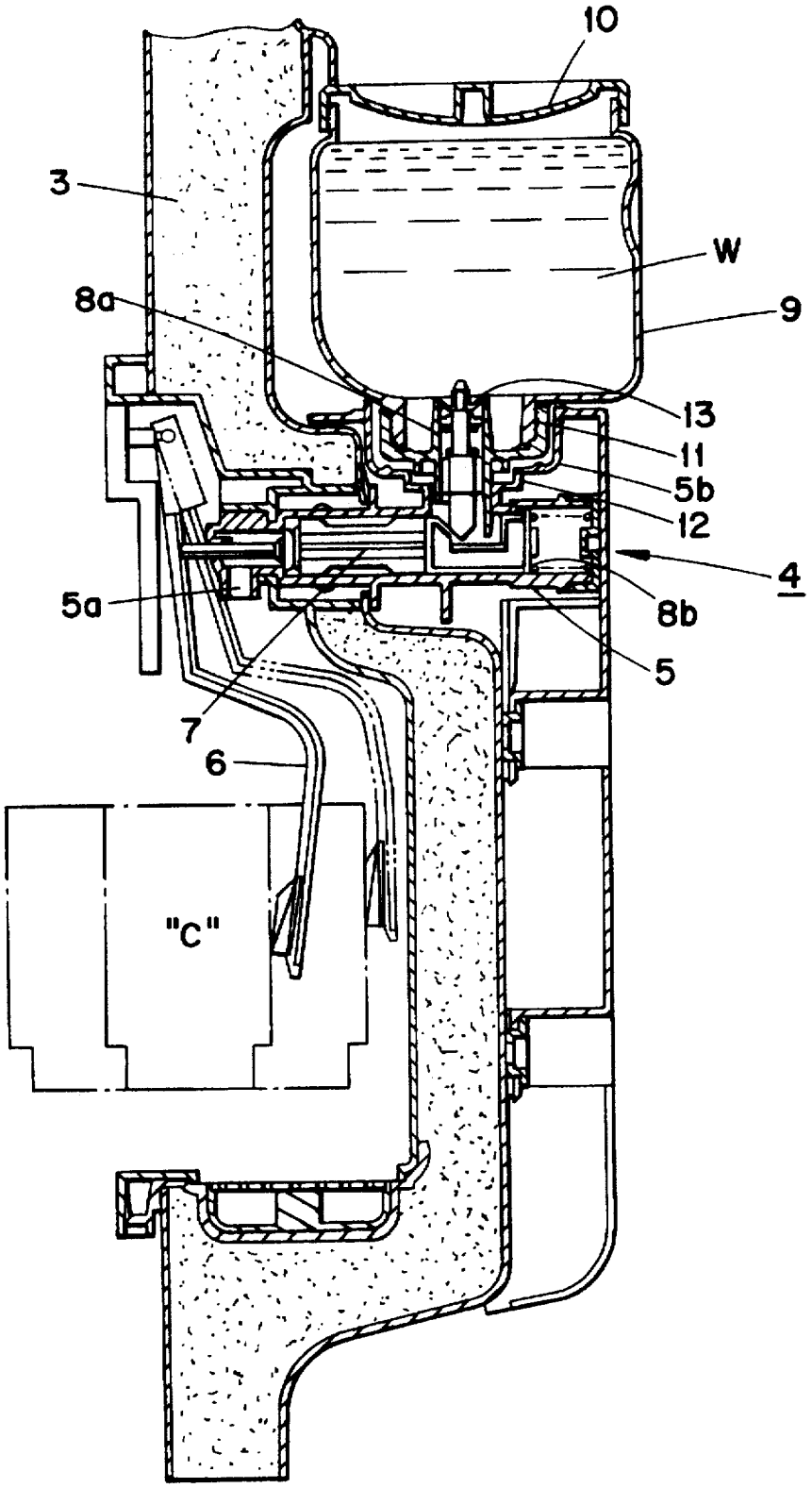
FIG. 2 (PRIOR ART)
FIG. 2 is an enlarged sectional view for illustrating a beverage dispensing apparatus according to the prior art.
Figure 3:
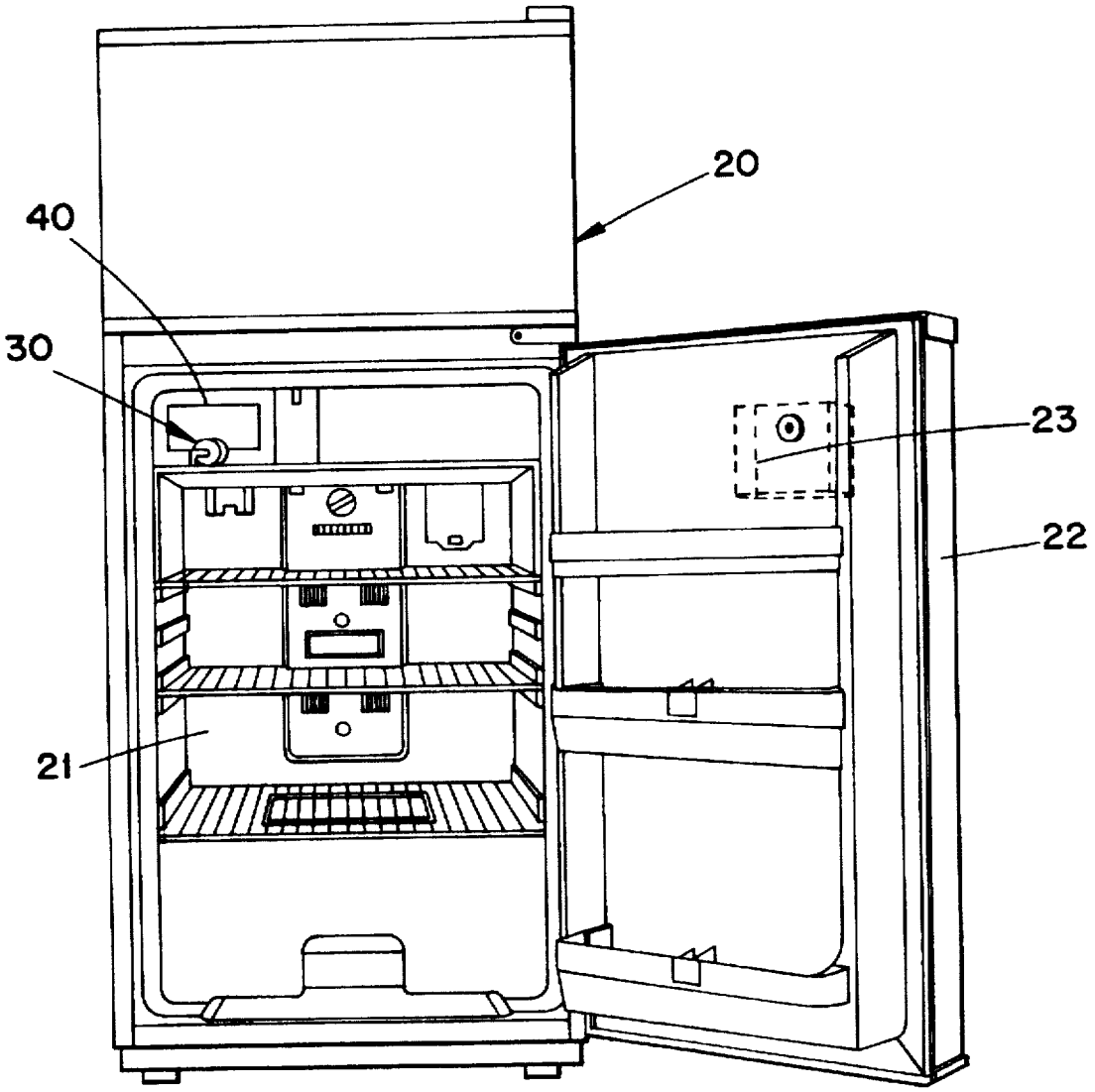
FIG. 3 is a perspective view for illustrating an interior of a refrigerator with a beverage dispensing apparatus for a refrigerator according to the present invention.

As shown in FIG. 3, a refrigerator is provided with a refrigerating compartment 21.

The refrigerating compartment 21 can be opened and closed by a door 22, and the refrigerating compartment 21 is provided at an upper side thereof with a cold water storage vessel 40 for storing cold water.

Meanwhile, the door 22 is provided at an outside upper part thereof with a water discharging recess 23.

The vessel 40 is provided at a lower side thereof with a valved spigot 30 which protrudes into the cold water discharging recess 23 when the door 20 is closed. That is, as will be explained in greater detail, the spigot 30 projects through a hole 24 in the door 22 when the door is closed, whereby the spigot becomes situated in the recess 23. When the user depresses a lever 52 carried by the door, a magnet 51 disposed on the lever is also depressed and repels a magnet attached to a valve 33 in the spigot, whereby the spigot opens to dispense cold water.

Therefore, a user can easily dispense cold water stored in the cold water storage vessel 40 without opening the door 22.

Figure 4:
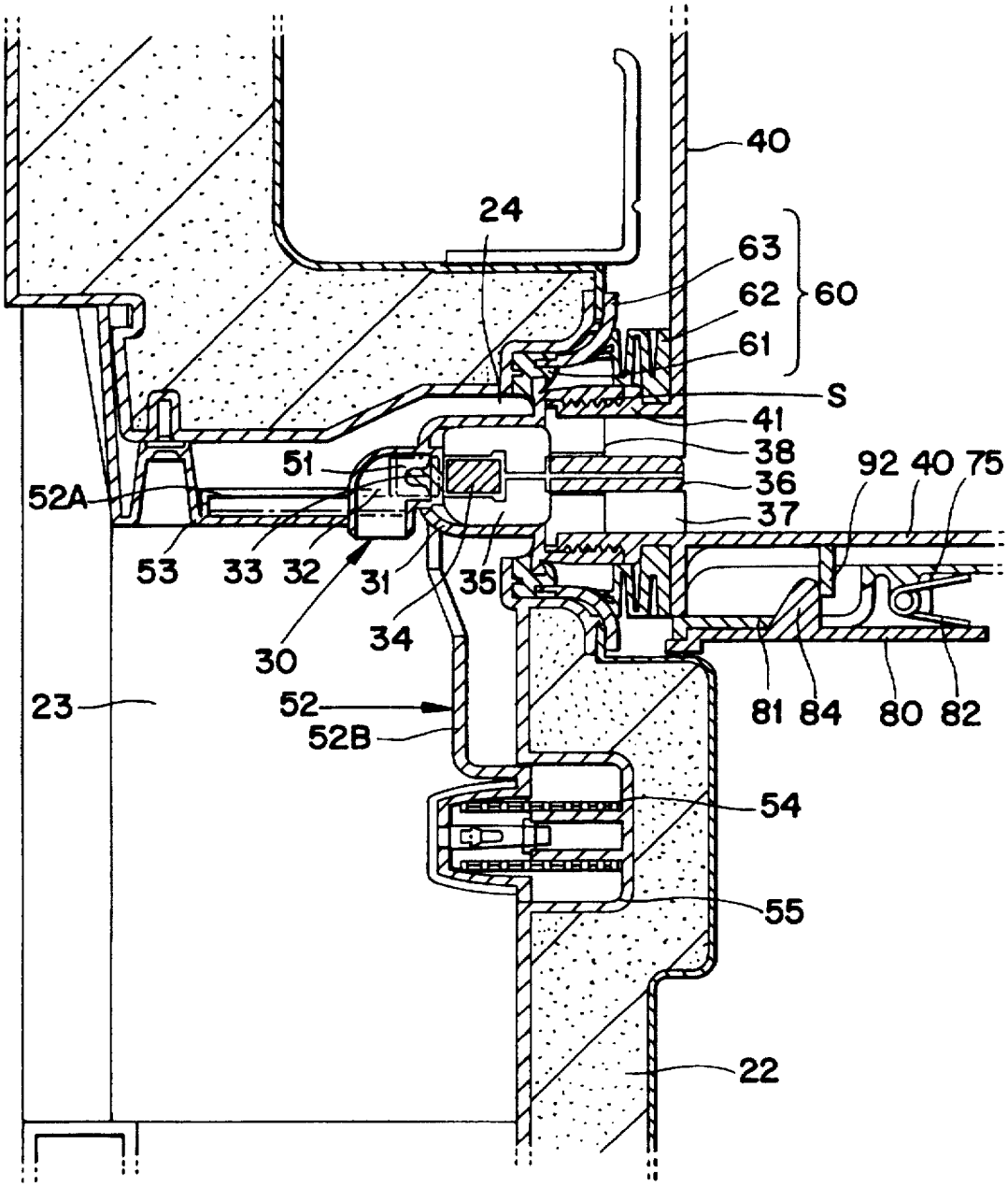
FIG. 4 is a sectional view taken along a vertical plane for illustrating the beverage dispensing apparatus for a refrigerator according to the present invention.
Figure 4A:
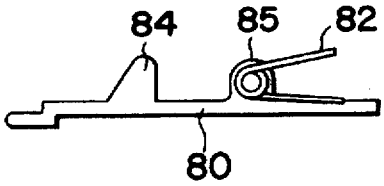
FIG. 4A is a side view of a supporting member depicted in FIG. 4.

As shown in FIG. 4, the vessel is seated on a slide plate 75. A latch 80 is hinged to the slide plate 75 by a hinge portion 85, and a spring 82 biases the latch clockwise in FIG. 4 so that a front part of the latch abuts a portion 81 of the slide plate 75. In that state, a detent 84 of the latch sits in front of a downward protrusion 40 of the vessel to restrain the vessel against movement to the left, and thereby retain the vessel in the refrigerator. By pushing up on the rear portion of the latch 80, the detent 84 moves down to enable the vessel to be removed, e.g., for cleaning.

The cooling water storage vessel 40 is provided at a lower side thereof with a water discharging member 41 which is protruded forward, and the water discharging member 41 is connected with the spigot 30.

The hole 24 is formed in the door 22 to enable the valve 30 to project into the recess 23 when the door is closed.

When the door 22 is closed, a front side of the spigot protrudes into the cooling water discharging recess 23 through the hole 24.

Figure 5:
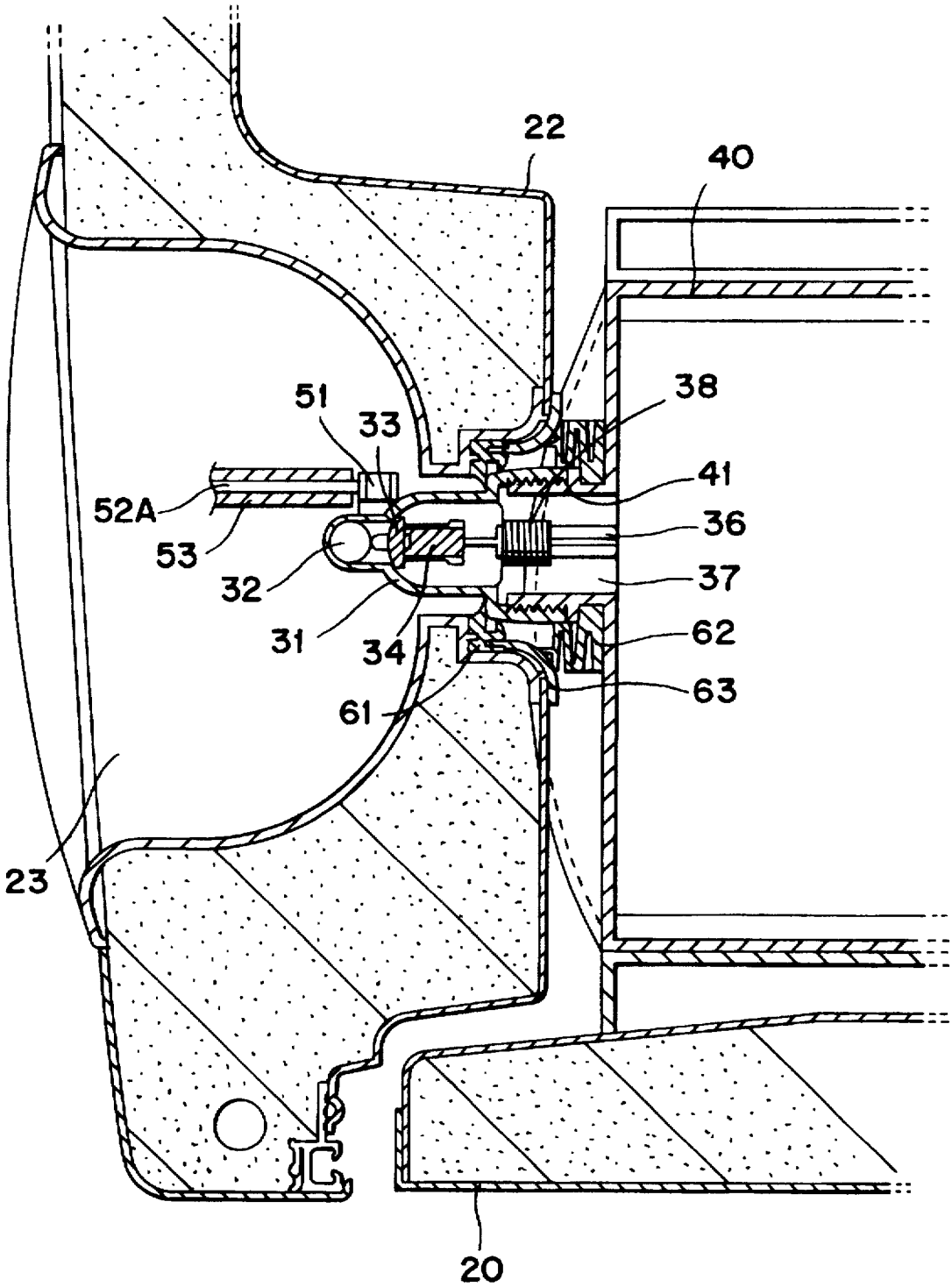
FIG. 5 is a sectional view taken along a horizontal plane for illustrating the beverage dispensing apparatus for a refrigerator according to the present invention.

The spigot 30, as shown in FIGS. 4 and 5, is coupled to the water discharging member 41 by a screw thread S formed in a hollow cylinder case 31 in which a water passage 32 is formed. Disposed in the spigot 30 are a valve member 33 for opening and closing the water passage 32, and a first permanent magnet 34 which moves together with the valve member 33.

Figure 6:
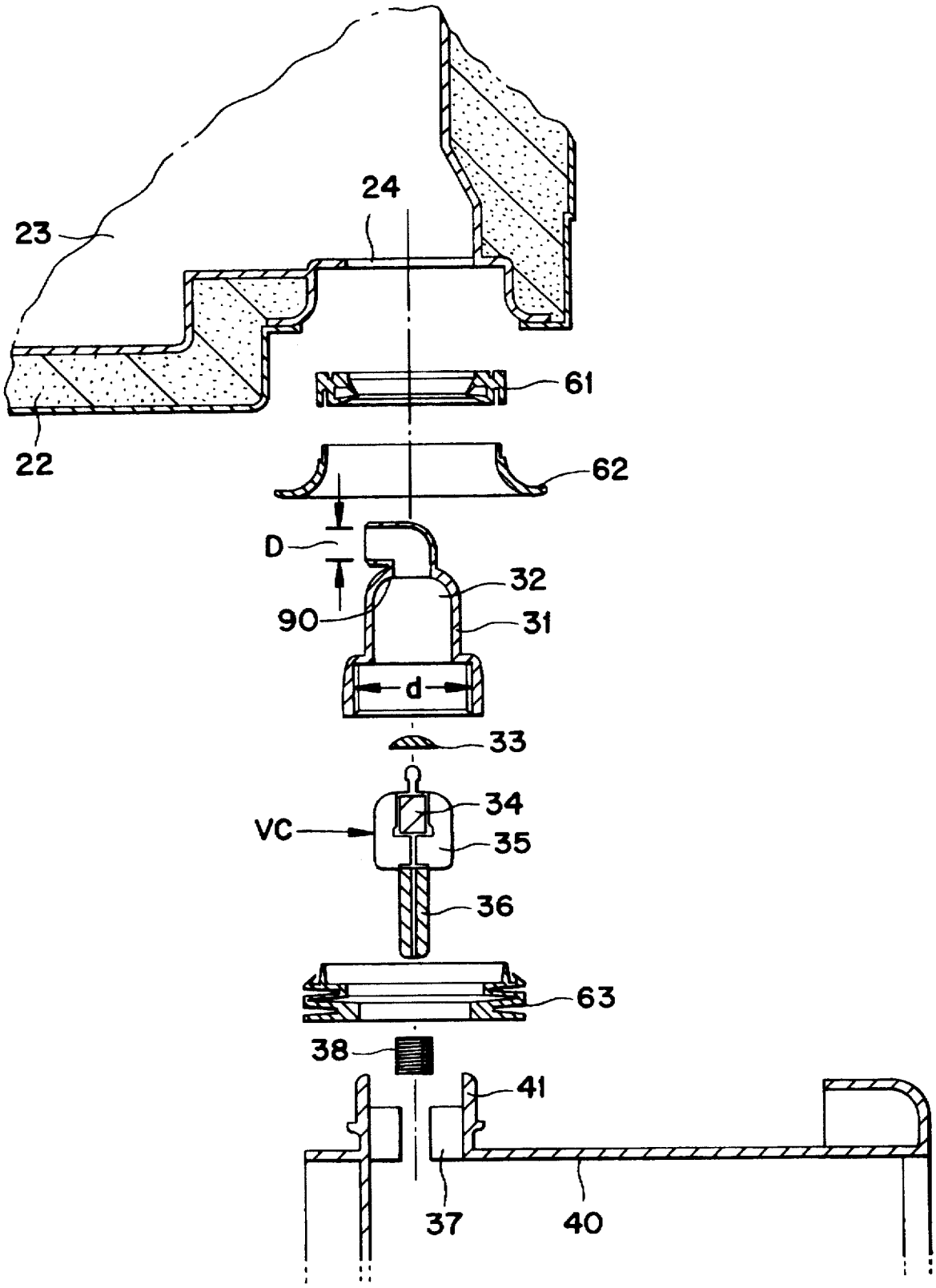
FIG. 6 is a dissolved sectional view for illustrating, valve means according to the present invention.

A diameter D of the front side of the water passage 32 is, as shown in FIG. 6, smaller than the diameter d of the rear side of it.

The valve member 33 is tightly pressed against a shoulder 90 of the water passage 32 by a spring 38.

A movable valve carrier VC (see FIG. 6) comprises a first rib 35 provided at a front side thereof with the valve member 33 and the first permanent magnet 34, which move together with the first rib 35, and also is provided at a rear side thereof with a bar 36.

The bar 36 has a rear part thereof positioned in a second rib 37 of the water discharging member 41, and the spring 38 is arranged between the first rib 36 and the second rib 37.

Meanwhile, the water discharging recess 23, as shown in FIG. 5, is provided with a second permanent magnet 51 for opening the water passage 32 by taking advantage of a repulsive power operating between the first permanent magnet 34 and the second permanent magnet 51.

A valve actuator 52 is movable backward and forward within the water discharging recess 1–3.

The actuator 52 is of "L" shape, in that it includes a vertical lower part 52B and a horizontal upper part 52A which intersect one another at a corner of the lever 52. A second permanent magnet 51 is mounted on that corner. The upper part 52A slides in a rail 53 that is fixed to the door.

The water discharging recess 23 is also provided at the lower side thereof with a spring 54 pressing against the vertical lower portion 52B of the actuator 52B for restoring the actuator to the former state.

The second permanent magnet 51 is disposed close to the first magnet 34.

The spring 54 is disposed in a groove 55, which is adapted to receive the lower end of the actuator 52 when the actuator is depressed.

A sealing means 60, as shown in FIGS. 4 and 6, is provided between the hole 24 and outlet 41, so as to prevent the cold air from leaking out.

The sealing means 60 comprises a first gasket 61 for pressing against the case 31 with the door 22 being closed, which gasket 61 is fixed to the door by way of a fixing member 63, and a second gasket 62 on the outlet 41 for being pressed by the fixing member 63 when the door is closed.

Now, the operation of the beverage dispensing apparatus for the refrigerator thus constructed will be described.

At first, it is assumed that the door 22 is closed, and the valve 33 is closed.

The first gasket 61 and the second gasket 62 are pressed tightly by the case 31 and the fixing member 63 to thereby not only prevent cool air from leaking out but also prevent hot air from leaking in.

At this time, if the user pushes the actuator 52 to the right in FIG. 4 so as to dispense cold water the second permanent magnet 51 which is arranged on the actuator 52 generates a repulsive power against the first permanent magnet 34.

Meanwhile, the first permanent magnet 34 which receives the repulsive power from the second permanent magnet 51 is moved rearward (to the right) against the spring 38 to thereby open the water passage 32 by shifting the valve member 33 backward, and subsequently cold water stored in the cold water storage vessel 40 is discharged through the water passage 32.

Furthermore, if the user releases the actuator 52 so as to stop the discharging operation of cold water, the actuator 52 is moved forward by the spring 54, and the second permanent magnet 51 which is mounted on the actuator 52 also moves forward.

Therefore the repulsive power which is applied to the first permanent magnet 34 decreases.

Subsequently, the valve member 33 moves forward as the first permanent magnet 34 is moved forward by the spring 38, to thereby shut the water passage 32, and finally cold water is not discharged any more.

Meanwhile, to clean the cold water storage vessel 40, that vessel is drawn out from the refrigerating chamber 21 after the detent 84 is separated from the protrusion 92 by pushing the rear part of the supporting member 80 upward against the spring 82.

The cold water storage vessel 40 is then moved along the upper part of the slide plate 75.

That is, when the rear part of the supporting member 80 is pushed up by the user with a force stronger than the elasticity of the spring 82, the front part of the supporting member 80 is moved downward about the hinge 85.

Therefore, the detent 84 moves down to release the protrusion 92.

The cooling water storage vessel 40 remains stationary while opening or closing, the door 22.

Although the preferred embodiment of the present invention has been disclosed for illustrative purposes, those skilled in the art will appreciate that various modifications, additions and substitutions are possible, without departing from the scope and spirit of the invention as defined by the accompanying claims.

What is claimed is:

1. A refrigerator comprising:

a body forming a refrigerating compartment;

a door for closing the refrigerating compartment;

a beverage storage vessel disposed in the refrigerating compartment and including a valved spigot which projects through a hole in the door when the door is closed so as to extend outside of the door;

a sealing structure for creating an air-tight seal between the spigot and hole when the door is closed;

a retainer for retaining the vessel in place during opening of the door; and a valve actuator mounted on the door for opening the valved spigot when the door is closed;

wherein the spigot includes a spigot body forming a beverage passage, and a valve disposed within the spigot body and movable between a passage-opening position and a passage-closing position, and a first magnet attached to the valve; the valve actuator movably mounted on the door between valve-opening and valve-closing positions, the valve actuator carrying a second magnet positioned to react with the first magnet to move the valve to its passage-opening position when the door is closed and the valve actuator is in its valve-opening position.

2. The refrigerator according to claim 1 wherein the first and second magnets are arranged to repel one another to move the valve to its passage-opening position.

3. The refrigerator according to claim 1, further including a spring for yieldably biasing the valve to its passage-closing position.

4. The refrigerator according to claim 3 wherein the vessel includes a vessel body to which the spigot is attached, the vessel body having a beverage outlet communicating with the water passage, and ribs projecting into the outlet to form a guide; a valve carrier including a rear end slidably mounted in the guide, and a front end carrying the valve and the first magnet.

5. The refrigerator according to claim 1 wherein the sealing structure includes a first sealing element, a fixing member for attaching the first sealing element to the door such that the first sealing element presses against the spigot when the door is closed; the sealing structure further including a second sealing element mounted on the vessel and being pressed against the fixing member when the door is closed.

6. The refrigerator according to claim 1 wherein the retainer is a manually releasable latch which enables the vessel to be removed from the refrigerating compartment.

7. The refrigerator according to claim 6 wherein the latch is pivotably mounted in the refrigerating compartment for movement between a latching position and a release position, a spring biasing the latch to its latching position wherein a detent of the latch sits in front of a portion of the vessel to prevent the vessel from being removed forwardly from the refrigerating compartment.

8. A beverage storage vessel adapted to be mounted in a refrigerating compartment of a refrigerator for dispensing a cold beverage through a door of the refrigerator, the vessel comprising:

a vessel body for storing a beverage and having a beverage outlet;

a spigot mounted on the vessel body and adapted to project through a refrigerator door when the door is closed, the spigot including:

a spigot body forming a beverage passage communicating with the outlet, a valve movably disposed within the spigot body between a passage-opening position and a passage-closing position, and a magnet attached to the valve, adapting the valve to be moved to its passage-opening position by a magnetic force generated between the magnet and another magnet carried by the door.

9. The water storage vessel according to claim 8 wherein the spigot further includes a spring for yieldably biasing the valve to its passage-closing position.

10. A refrigerator comprising:

a body forming a refrigerating compartment;

a door for closing the refrigerating compartment;

a beverage storage vessel disposed in the refrigerating compartment and including a valved spigot which projects through the door when the door is closed so as to extend outside of the door;

a sealing structure for creating an air-tight seal between the spigot and hole when the door is closed; and a retainer for retaining the vessel in place during opening of the door;

wherein the sealing structure includes a first sealing element, a fixing member for attaching the first sealing element to the door such that the first sealing element presses against the spigot when the door is closed; the sealing structure further including a second sealing element mounted on the vessel and being pressed against the fixing member when the door is closed.

* * * * *